US007151837B2

(12) United States Patent
Bank et al.

(10) Patent No.: US 7,151,837 B2
(45) Date of Patent: Dec. 19, 2006

(54) LOUDSPEAKER

(75) Inventors: Graham Bank, Woodbridge (GB); Martin Colloms, London (GB); Neil Simon Owen, Huntingdon (GB); Neil Harris, Cambridge (GB); Martin Christopher Cassey, Cambridge (GB)

(73) Assignee: New Transducers Limited, London (GB)

( * ) Notice: Subject to any disclaimer, the term of this patent is extended or adjusted under 35 U.S.C. 154(b) by 25 days.

(21) Appl. No.: 10/201,631

(22) Filed: Jul. 24, 2002

(65) Prior Publication Data

US 2003/0059069 A1 Mar. 27, 2003

Related U.S. Application Data

(63) Continuation-in-part of application No. 09/768,002, filed on Jan. 24, 2001.

(60) Provisional application No. 60/309,792, filed on Aug. 6, 2001, provisional application No. 60/218,062, filed on Jul. 13, 2000, provisional application No. 60/205,465, filed on May 19, 2000, provisional application No. 60/178,315, filed on Jan. 27, 2000.

(30) Foreign Application Priority Data

Aug. 1, 2001 (GB) ..... 0118750.9

(51) Int. Cl.
*H04R 25/00* (2006.01)
*H04R 7/04* (2006.01)

(52) U.S. Cl. ..... 381/190; 381/152; 381/431

(58) Field of Classification Search ..... 381/152, 381/190, 191, 431; 181/157, 164, 166, 167, 181/171, 173, 175; 310/326, 354
See application file for complete search history.

(56) References Cited

U.S. PATENT DOCUMENTS

| | | | | | |
|---|---|---|---|---|---|
| 3,109,153 | A | * | 10/1963 | Rodek | 310/354 |
| 4,078,160 | A | | 3/1978 | Bost | |
| 4,352,961 | A | * | 10/1982 | Kumada et al. | 381/152 |
| 4,367,426 | A | * | 1/1983 | Kumada et al. | 310/358 |
| 4,401,857 | A | | 8/1983 | Morikawa | |
| 4,414,436 | A | | 11/1983 | Sashida et al. | |
| 4,481,663 | A | | 11/1984 | Spranger | |
| 4,593,160 | A | | 6/1986 | Nakamura | |
| 4,820,952 | A | * | 4/1989 | Lee | 310/334 |
| 4,940,914 | A | * | 7/1990 | Mizuno et al. | 310/326 |

(Continued)

FOREIGN PATENT DOCUMENTS

EP 0 711 096 A1 5/1996

(Continued)

OTHER PUBLICATIONS

Jonathan R. Bost et al.; "A New Piezoelectric Driver Enhances Horn Performance," AES, An Audio Engineering Society Preprint, Preprint 1374 (D-6), presented May 2-5, 1978, pp. 1-14.

*Primary Examiner*—Sinh Tran
*Assistant Examiner*—Brian Ensey
(74) *Attorney, Agent, or Firm*—Foley & Lardner LLP

(57) ABSTRACT

A bending wave loudspeaker includes a transparent acoustic radiator capable of supporting bending wave vibration and an electromechanical force transducer mounted to the acoustic radiator to excite bending waves in the acoustic radiator to produce an acoustic output. The transducer has an intended operative frequency range and includes a resonant element having a frequency distribution of modes in the operative frequency range and a coupler for mounting the transducer to the acoustic radiator. The loudspeaker may be incorporated in a telephone handset or a visual display unit.

30 Claims, 5 Drawing Sheets

U.S. PATENT DOCUMENTS

| | | | | |
|---|---|---|---|---|
| 5,632,841 | A | 5/1997 | Hellbaum et al. | |
| 5,736,808 | A | 4/1998 | Szilagyi et al. | |
| 5,802,195 | A | 9/1998 | Regan et al. | |
| 6,031,926 | A | 2/2000 | Azima et al. | |
| 6,195,440 | B1 | 2/2001 | Warnaka et al. | |
| 6,215,884 | B1 | 4/2001 | Parrella et al. | |
| 6,332,029 | B1 | 12/2001 | Azima et al. | |
| 6,377,695 | B1 | 4/2002 | Azima et al. | |
| 6,396,197 | B1 * | 5/2002 | Szilagyi et al. | 310/330 |
| 6,427,017 | B1 * | 7/2002 | Toki | 381/190 |
| 6,480,614 | B1 | 11/2002 | Denda et al. | |
| 6,519,346 | B1 | 2/2003 | Asada et al. | |
| 6,554,098 | B1 * | 4/2003 | Komura | 181/173 |
| 6,621,908 | B1 * | 9/2003 | Asada et al. | 381/152 |
| 2001/0026626 | A1 * | 10/2001 | Athanas | 381/190 |
| 2001/0033669 | A1 | 10/2001 | Bank et al. | |
| 2003/0002697 | A1 * | 1/2003 | Mellow | 381/190 |
| 2003/0053642 | A1 | 3/2003 | Bank et al. | |

FOREIGN PATENT DOCUMENTS

| | | | | |
|---|---|---|---|---|
| EP | 0 881 856 | A1 | | 12/1998 |
| EP | 0 993 231 | A2 | | 4/2000 |
| FR | 2649575 | | * | 7/1989 |
| GB | 2 166 022 | A | | 4/1986 |
| WO | WO 83/02364 | A1 | | 7/1983 |
| WO | WO 96/31333 | A1 | | 10/1996 |
| WO | WO 97/09842 | A2 | | 3/1997 |
| WO | WO 97/09844 | A1 | | 3/1997 |
| WO | WO 97/09846 | A1 | | 3/1997 |
| WO | WO 97/09854 | A2 | | 3/1997 |
| WO | WO 98/42536 | A1 | | 10/1998 |
| WO | WO 98/52383 | A1 | | 11/1998 |
| WO | WO 98/58416 | A1 | | 12/1998 |
| WO | WO 98/58521 | A1 | | 12/1998 |
| WO | WO 99/08479 | A1 | | 2/1999 |
| WO | WO 99/11490 | A1 | | 3/1999 |
| WO | WO 99/37121 | A1 | | 7/1999 |
| WO | WO 99/41939 | A1 | | 8/1999 |
| WO | WO 00/02417 | A1 | | 1/2000 |
| WO | WO 00/13464 | A1 | | 3/2000 |
| WO | WO 00/33612 | A2 | | 6/2000 |
| WO | WO 00/45616 | A1 | | 8/2000 |
| WO | WO 00/48425 | A2 | | 8/2000 |
| WO | WO 01/54450 | A2 | | 7/2001 |

* cited by examiner

LOUDSPEAKER

CROSS-REFERENCE TO RELATED APPLICATIONS

This application claims the benefit of U.S. Provisional Application Ser. No. 60/309,792, filed Aug. 6, 2001 (incorporated by reference in its entirety), and is a continuation-in-part application of U.S. patent application Ser. No. 09/768,002 filed Jan. 24, 2001, which claims the benefit of U.S. Provisional Application Ser. Nos. 60/178,315, filed Jan. 27, 2000, 60/205,465, filed May 19, 2000, and 60/218,062, filed Jul. 13, 2000.

BACKGROUND

This invention relates to a bending wave panel speaker, particularly but not exclusively, bending wave panel speakers known as distributed mode loudspeakers, e.g., as taught in WO 97/09842 and corresponding U.S. Pat. No. 6,332,029, the latter of which is herein incorporated by reference.

It is known from WO 97/09842 (U.S. Pat. No. 6,332,029) and other publications (e.g. WO97/09846 (U.S. patent application Ser. No. 09/029,360), WO99/08479 (U.S. patent application Ser. No. 09/497,655) and WO00/33612 (U.S. patent application Ser. No. 09/450,754)) in the name of New Transducers Limited to apply one or more exciters to a bending wave panel for energising bending waves in the panel. The locations of the exciters may be chosen with consideration for modal drive coupling, moderating directional effects or adjusting behaviour through the coincidence frequency region.

SUMMARY OF THE INVENTION

According to the invention, there is provided a bending wave loudspeaker comprising an acoustic radiator capable of supporting bending wave vibration and an electromechanical force transducer mounted to the acoustic radiator to excite bending wave vibration in the acoustic radiator to produce an acoustic output, the transducer having an intended operative frequency range and comprising a resonant element having a frequency distribution of modes in the operative frequency range and a coupler or coupling means on the resonant element for mounting the transducer to the acoustic radiator, wherein the acoustic radiator is transparent.

The loudspeaker may further comprise a mask which obscures the transducer. The loudspeaker may be suspended in a frame, which may be open or closed. The frame may be adapted for mounting in another structure.

The resonant element may be active, e.g., it may be a piezoelectric transducer and it may be in the form of a strip of piezoelectric material. Alternatively, the resonant element may be passive and the transducer may further comprise an active transducer, e.g., an inertial or grounded vibration transducer, actuator or exciter, e.g., a moving coil transducer. The active transducer may be a bending or torsional transducer (e.g. of the type taught in WO00/13464 (U.S. patent application Ser. No. 09/384,419)). Furthermore, the transducer may comprise a combination of passive and active elements to form a hybrid transducer.

A number of transducer, exciter, or actuator mechanisms have been developed to apply a force to a structure such as an acoustic radiator of a loudspeaker. There are various types of these transducer mechanisms, for example moving coil, moving magnet, piezoelectric, or magnetostrictive types. Typically, electrodynamic speakers using coil and magnet type transducers lose 99% of their input energy to heat whereas a piezoelectric transducer may lose as little as 1%. Thus, piezoelectric transducers are popular because of their high efficiency.

There are several problems with piezoelectric transducers, for example, they are inherently very stiff, for example comparable to brass foil, and are, therefore, thus difficult to match to an acoustic radiator, especially to the air. Raising the stiffness of the transducer moves the fundamental resonant mode to a higher frequency. Thus, such piezoelectric transducers may be considered to have two operating ranges. The first operating range is below the fundamental resonance of the transducer. This is the "stiffness controlled" range where velocity rises with frequency and the output response usually needs equalisation. This leads to a loss in available efficiency. The second range is the resonance range beyond the stiffness range, which is generally avoided because the resonances are rather fierce.

Moreover, the general teaching is to suppress resonances in a transducer. Thus, piezoelectric transducers are generally used only used in the frequency range below or at the fundamental resonance of the transducers. Where piezoelectric transducers are used above the fundamental resonance frequency it is necessary to apply damping to suppress resonance peaks.

The problems associated with piezoelectric transducers similarly apply to transducers comprising other "smart" materials, i.e., magnetostrictive, electrostrictive, and electret type materials. Various piezoelectric transducers are also known, for example as described in EP 0993 231A of Shinsei Corporation, EP 0881 856A of Shinsei Corporation, U.S. Pat. No. 4,593,160 of Murata Manufacturing Co. Limited, U.S. Pat. No. 4,401,857 of Sanyo Electric Co. Limited, U.S. Pat. No. 4,481,663 of Altec Corporation and UK patent application GB2,166,022A of Sawafuji. However, it is an object of the invention to employ an improved transducer.

The transducer used in the present invention may be considered to be an intendedly modal transducer. The coupler may be attached to the resonant element at a position which is beneficial for coupling modal activity of the resonant element to the interface. The parameters (e.g., aspect ratio, bending stiffness, thickness and geometry) of the resonant element may be selected to enhance the distribution of modes in the resonant element in the operative frequency range. The bending stiffness and thickness of the resonant element may be selected to be isotropic or anisotropic. The variation of bending stiffness and/or thickness may be selected to enhance the distribution of modes in the resonant element. Analysis (e.g., computer simulation using FEA or modelling) may be used to select the parameters.

The distribution may be enhanced by ensuring a first mode of the active element is near to the lowest operating frequency of interest. The distribution may also be enhanced by ensuring a satisfactory, e.g. high, density of modes in the operative frequency range. The density of modes is preferably sufficient for the active element to provide an effective mean average force which is substantially constant with frequency. Good energy transfer may provide beneficial smoothing of modal resonances. Alternatively, or additionally, the distribution of modes may be enhanced by distributing the resonant bending wave modes substantially evenly in frequency, i.e. to smooth peaks in the frequency response caused by "bunching" or clustering of the modes. Such a transducer may thus be known as a distributed mode transducer or DMT.

Such an intendedly modal or distributed mode transducer is described in International patent application WO01/54450 and U.S. patent application Ser. No. 09/768,002, filed Jan. 24, 2001 (the latter of which is herein incorporated by reference in its entirety).

The transducer may comprise a plurality of resonant elements each having a distribution of modes, the modes of the resonant elements arranged to interleave in the operative frequency range and enhance the distribution of modes in the transducer. The resonant elements may have different fundamental frequencies and thus, the parameters (e.g., loading, geometry or bending stiffness) of the resonant elements may be different.

The resonant elements may be coupled together by a connector or connecting means in any convenient way, e.g. on generally stiff stubs, between the elements. The resonant elements are preferably coupled at coupling points which enhance the modality of the transducer and/or enhance the coupling at the site to which the force is to be applied. Parameters of the connecting means may be selected to enhance the modal distribution in the resonant element. The resonant elements may be arranged in a stack. The coupling points may be axially aligned.

The resonant element may be plate-like or may be curved out of planar. A plate-like resonant element may be formed with slots or discontinuities to form a multi-resonant system. The resonant element may be beam-shaped, trapezoidal, hyperelliptical, or may be generally disc shaped. Alternatively, the resonant element may be rectangular and may be curved out of the plane of the rectangle about an axis along the short axis of symmetry.

The resonant element may be modal along two substantially normal axes, each axis having an associated fundamental frequency. The ratio of the two fundamental frequencies may be adjusted for best modal distribution, e.g., about 9:7 (~1.286:1).

As examples, the arrangement of such a modal transducer may be any of: a flat piezoelectric disc; a combination of at least two or preferably at least three flat piezoelectric discs; two coincident piezoelectric beams; a combination of multiple coincident piezoelectric beams; a curved piezoelectric plate; a combination of multiple curved piezoelectric plates or two coincident curved piezoelectric beams.

The interleaving of the distribution of the modes in each resonant element may be enhanced by optimising the frequency ratio of the resonant elements, namely the ratio of the frequencies of each fundamental resonance of each resonant element. Thus, the parameter of each resonant element relative to one another may be altered to enhance the overall modal distribution of the transducer.

When using two active resonant elements in the form of beams, the two beams may have a frequency ratio (i.e., ratio of fundamental frequency) of about 1.27:1. For a transducer comprising three beams, the frequency ratio may be about 1.315:1.147:1. For a transducer comprising two discs, the frequency ratio may be about 1.1+/−0.02 to 1 to optimise high order modal density or may be about about 3.2 to 1 to optimise low order modal density. For a transducer comprising three discs, the frequency ratio may be about 3.03:1.63:1 or may be about 8.19:3.20:1.

The parameters of the coupler may be selected to enhance the distribution of modes in the resonant element in the operative frequency range. The coupler may be vestigial, e.g., a controlled layer of adhesive.

The coupler may be positioned asymmetrically with respect to the panel so that the transducer is coupled asymmetrically. The asymmetry may be achieved in several ways, for example by adjusting the position or orientation of the transducer with respect to axes of symmetry in the panel or the transducer.

The coupler may form a line of attachment. Alternatively, the coupler may form a point or small local area of attachment where the area of attachment is small in relation to the size of the resonant element. The coupler may be in the form of a stub and have a small diameter, e.g., about 3 to 4 mm. The coupler may be low mass.

The coupler may comprise more than one coupling point and may comprise a combination of points and/or lines of attachment. For example, two points or small local areas of attachment may be used, one positioned near centre and one positioned at the edge of the active element. This may be useful for plate-like transducers which are generally stiff and have high natural resonance frequencies.

Alternatively only a single coupling point may be provided. This may provide the benefit, in the case of a multi-resonant element array, that the output of all the resonant elements is summed through the single coupler so that it is not necessary for the output to be summed by the load. The coupler may be chosen to be located at an anti-node on the resonant element and may be chosen to deliver a constant average force with frequency. The coupler may be positioned away from the centre of the resonant element.

The position and/or the orientation of the line of attachment may be chosen to optimise the modal density of the resonant element. The line of attachment is preferably not coincident with a line of symmetry of the resonant element. For example, for a rectangular resonant element, the line of attachment may be offset from the short axis of symmetry (or centre line) of the resonant element. The line of attachment may have an orientation which is not parallel to a symmetry axis of the panel.

The shape of the resonant element may be selected to provide an off-centre line of attachment which is generally at the centre of mass of the resonant element. One advantage of this embodiment is that the transducer is attached at its centre of mass and thus there is no inertial imbalance. This may be achieved by an asymmetric shaped resonant element which may be in the shape of a trapezium or trapezoid.

For a transducer comprising a beam-like or generally rectangular resonant element, the line of attachment may extend across the width of the resonant element. The area of the resonant element may be small relative to that of the acoustic radiator.

The acoustic radiator may be in the form of a panel. The panel may be flat and may be lightweight. The material of the acoustic radiator may be anisotropic or isotropic.

The acoustic radiator may have a distribution of resonant bending wave modes and may produce an acoustic output when the modes are excited by the transducer. The properties of the acoustic radiator may be chosen to distribute the resonant bending wave modes substantially evenly in frequency (i.e., to smooth peaks in the frequency response caused by "bunching" or clustering of the modes).

In particular, the properties of the acoustic radiator may be chosen to distribute the lower frequency resonant bending wave modes substantially evenly in frequency. The lower frequency resonant bending wave modes are preferably the ten to twenty lowest frequency resonant bending wave modes of the acoustic radiator.

The parameters of the transducer may be selected to match the mechanical properties of the transducer to those of the acoustic radiator. By matching the source (transducer)

and load (acoustic radiator) mechanical impedances, mechanical power may be transmitted with high efficiency.

The transducer location may be chosen to couple substantially evenly to the resonant bending wave modes in the acoustic radiator, in particular to lower frequency resonant bending wave modes. In other words, the transducer may be mounted at a location where the number of vibrationally active resonance anti-nodes in the acoustic radiator is relatively high and conversely the number of resonance nodes is relatively low. Any such location may be used, but the most convenient locations are the near-central locations between about 38% to about 62% along each of the length and width axes of the acoustic radiator, but off-centre. Specific or preferential locations are at about 3/7, about 4/9 or about 5/13 of the distance along the axes; a different ratio for the length axis and the width axis is preferred. Preferred is about 4/9 length and about 3/7 width of an isotropic panel having an aspect ratio of about 1:1.13 or about 1:1.41.

Alternatively, the transducers may be mounted to an edge or marginal portion of the acoustic radiator, e.g. as taught in International application WO00/02417 and U.S. patent application Ser. No. 09/752,830, the latter of which is herein incorporated by reference. The edge or marginal portion of the acoustic radiator may be clamped to improve acoustic performance as taught in WO99/37121 and U.S. patent application Ser. No. 09/233,037, the latter of which is herein incorporated by reference.

The operative frequency range may be over a relatively broad frequency range and may be in the audio range and/or ultrasonic range. There may also be applications for sonar and sound ranging and imaging where a wider bandwidth and/or higher possible power will be useful by virtue of distributed mode transducer operation. Thus, operation over a range greater than the range defined by a single dominant, natural resonance of the transducer may be achieved.

The lowest frequency in the operative frequency range is preferably above a predetermined lower limit which is about the fundamental resonance of the transducer.

For example, for a beam-like active resonant element, the force may be taken from the centre of the beam, and may be matched to the mode shape in the acoustic radiator to which it is attached. In this way, the action and reaction may co-operate to give a constant output with frequency. By connecting the resonant element to the acoustic radiator, at an anti-node of the resonant element, the first resonance of the resonant element may appear to be a low impedance. In this way, the acoustic radiator should not amplify the resonance of the resonant element.

According to a second embodiment of the invention, there is provided a telephone handset, e.g. for a mobile phone or wireless telephone, comprising a body supporting a microphone, keys, a display, and a window mounted over the display. The handset further comprises a loudspeaker as described above and the window acts as the acoustic radiator of the loudspeaker.

The window may be supported on the body via a suspension whereby vibration from the window is prevented from being transmitted by the body to the microphone.

According to a third embodiment of the invention, there is provided a visual display unit, e.g. a television, comprising a body supporting a display unit, e.g. LCD or TFT display unit, and a window mounted over the display. The visual display unit further comprises a loudspeaker as described above and the window acts as the acoustic radiator of the loudspeaker.

BRIEF DESCRIPTION OF DRAWINGS

Examples that embody the best mode for carrying out the invention are described in detail below and are diagrammatically illustrated in the accompanying drawings in which.

DETAILED DESCRIPTION

Figure 1:
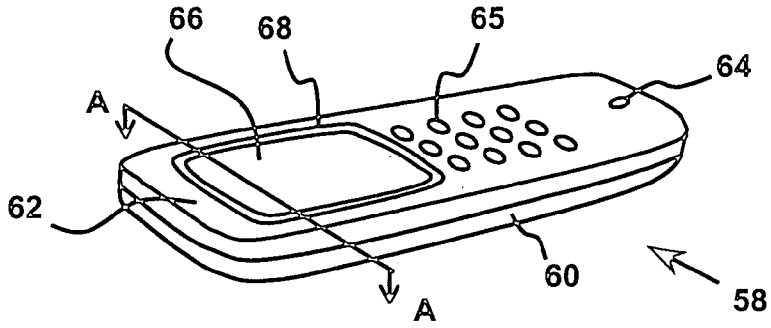
FIG. 1 shows a perspective view of a handset embodying the present invention.
Figure 2:
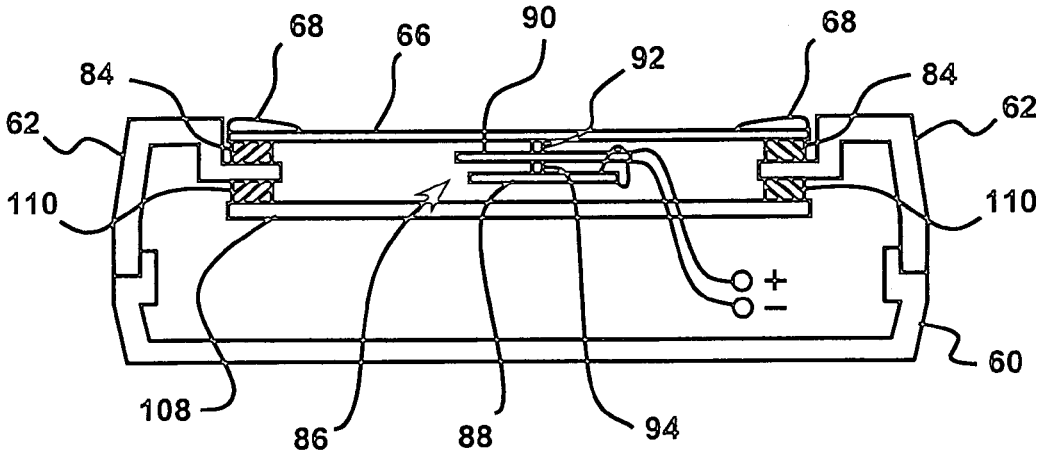
FIG. 2 shows a cross-sectional view taken along line AA of FIG. 1.

FIGS. 1 and 2 show a telephone handset (58) which may be in the form of a mobile phone, wireless telephone handset, or handset connected to a landline. The handset (58) comprises a back part (60) and a front part (62) which carries the standard components, namely a microphone (64), keys (65) and a display window (66) fitted with an opaque surround (68). The display window (66) is fitted above a display (108) which may be a liquid crystal display (LCD) or thin film transistor (TFT) display. The display (108) is supported on the front part (62) by a suspension (110), which is fitted around the periphery of the display (108).

The display window (66) is in the form of a panel which is designed to be capable of supporting bending waves, particularly resonant bending wave modes as taught in WO97/09842 (U.S. Pat. No. 6,332,029) and WO97/09854 (U.S. patent application Ser. No. 09/029,059) of the present applicant. A transducer (86) is mounted to the display window (66) to launch or to excite bending wave vibration to produce an acoustic output. The transducer (86) is an intendedly modal transducer or distributed mode transducer as hereinbefore described and as described in WO01/54450 and in U.S. patent application Ser. No. 09/768,002.

The transducer (86) comprises upper and lower bimorph beams (90, 88) interconnected by a stub (94), the upper beam (90) being connected to the display window (66) by a stub (92) which extends across the width of the beams. The stub (92) may be about 1–2 mm wide and high and may be made from hard plastics and/or metal with suitable insulating layers to prevent electrical short circuits. The beams (90, 88) are of transparent material (i.e., PZLT material) used with thin film electrodes. Thus, the transducer (86) is substantially transparent although there may be a minor visual obstruction caused by the stubs.

The beams (90, 88) are of unequal lengths; the upper beam (90) is longer than the lower beam (88). Each beam (90, 88) can consist of three layers, namely two outer layers of piezoelectric ceramic material, e.g. PZT 5H, sandwiching a central brass vane layer. The outer layers may be attached to the brass vane layer by adhesive layers which are typically about 10–15 microns thick.

The display window (66) is mounted into the front part (62) by way of a suspension (84) which extends around the periphery of the window. The suspension (84) sets the boundary condition for the display window (66) and may be used to prevent structure borne vibration from being transmitted from the window (66) back to the microphone (64).

Figure 3:
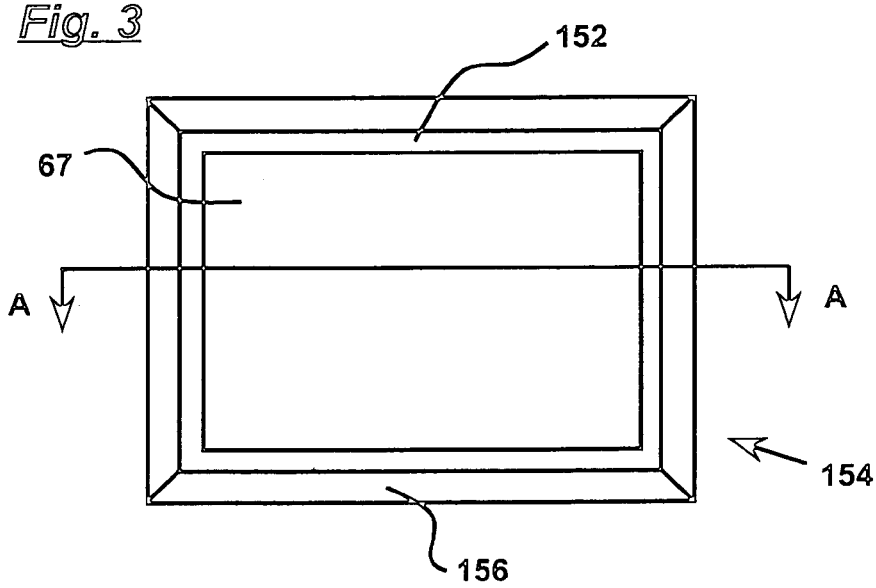
FIG. 3 shows a front view of a loudspeaker embodying the present invention.

FIG. 3 shows a loudspeaker (154) which comprises a panel (67) which is designed to be capable of supporting bending waves, particularly resonant bending wave modes. The panel (67) is made from a transparent material, e.g. glass. A transducer (not shown) is mounted near an edge of the panel to excite it to produce vibration to produce an acoustic output. A mask (152) is mounted in front of the edges of the panel (67) to obscure the transducer. The panel (67) is suspended in a frame (156), whereby the loudspeaker may be adapted for mounting in any location.

Figure 4:
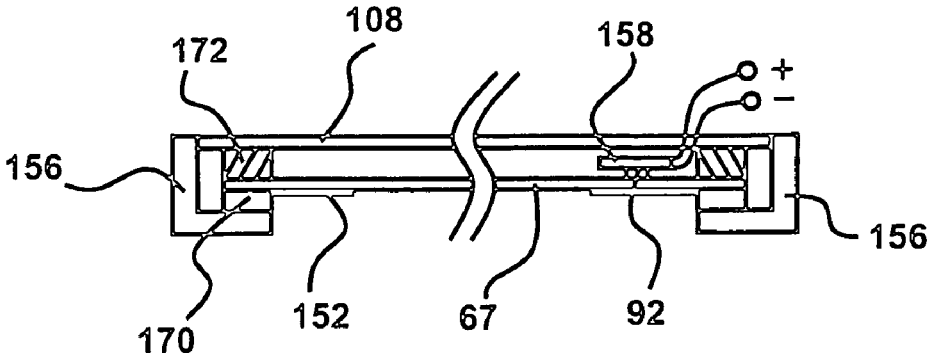
FIG. 4 is a cross-sectional view of a loudspeaker taken along line AA of FIG. 3 mounted in a frame.

FIG. 4 shows an application of the loudspeaker of FIG. 3. The loudspeaker forms a window panel for a display (108) which is supported on the frame (156) by a flexible front suspension (170) which extends around the periphery of the display. The loudspeaker is supported in the frame (156) by a flexible rear suspension (172) which extends around the periphery of the panel (67).

The panel (67) is driven by an intendedly modal transducer (158) by way of a stub (92). The transducer (158) is in the form of a piezoelectric plate which is driven by an input through connection leads. The transducer (158) is obscured from a viewer by the mask (152) which may be printed onto the front or back surface of the panel (67).

The remaining figures show alternative transducers which may be used in conjunction with the loudspeaker applications embodied in FIGS. 1 to 4. Each transducer is capable of being mounted to a transparent panel or other load device. An intendedly modal transducer may be designed with reduced mass and depth compared to a moving coil/permanent magnet design. Accordingly, the use of such a transducer should reduce the overall weight of the loudspeaker and the transducer should be suitable for installations in which space is limited, e.g. in phone handsets. For example, a standard moving coil electromagnetic transducer generally has a weight of approximately 30 g and a height of approximately 13 mm. In contrast, a two-beam modal transducer may have a weight of only approximately 2 g and a height of approximately 5 mm.

Figure 5:
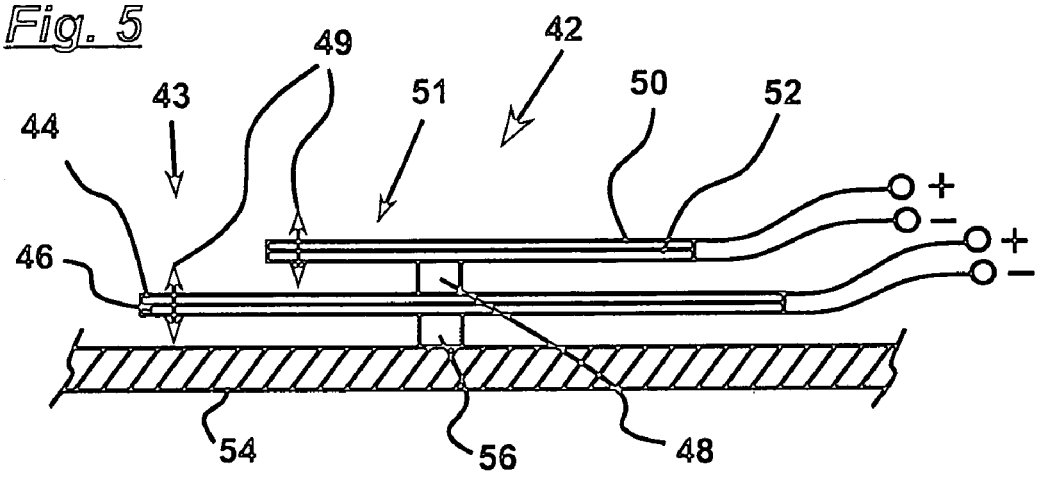
FIGS. 5 to 11 are side views of alternative modal transducers which may be used in the present invention.

FIG. 5 shows a transducer (42) which comprises a first piezoelectric beam (43) on the back of which is mounted a second piezoelectric beam (51) by connecting means in the form of a stub (48) located at the centre of both beams (43, 51). Each beam (43, 51) is a bi-morph. The first beam (43) comprises two layers (44,46) of piezoelectric material and the second beam (51) comprises two layers (50,52). The poling directions of each layer of piezoelectric material are shown by arrows (49). Each layer (44, 50) has an opposite poling direction to the other layers (46, 52), respectively, in the bi-morph. The bimorph may also comprise a central conducting vane which allows a parallel electrical connection as well as adding a strengthening component to the ceramic piezoelectric layers. Each layer of each beam (43, 51) may be made of the same/different piezoelectric material. Each layer is generally of a different length.

The first piezoelectric beam (43) is mounted on a panel (54) by a coupler or coupling means in the form of a stub (56) located at the centre of the first beam. By mounting the first beam (43) at its centre only the even order modes will produce output. By locating the second beam (51) behind the first beam (43), and coupling both beams (43, 51) centrally by way of a stub (48) they can both be considered to be driving the same axially aligned or co-incident position.

When the beams are joined together, the resulting distribution of modes is not the sum of the separate sets of frequencies, because each beam modifies the modes of the other. The two beams are designed so that their individual modal distributions are interleaved to enhance the overall modality of the transducer. The two beams add together to produce a useable output over a frequency range of interest. Local narrow dips occur because of the interaction between the piezoelectric beams at their individual even order modes.

The second beam may be chosen by using the ratio of the fundamental resonance of the two beams. If the materials and thicknesses are identical, then the ratio of frequencies is just the square of the ratio of lengths. If the higher f0 (fundamental frequency) is simply placed half way between f0 and f1 of the other, larger beam, f3 of the smaller beam and f4 of the lower beam coincide.

Plotting a graph of a cost function against the ratio of the frequency for two beams shows that the ideal ratio is about 1.27:1, namely where the cost function is minimised at point. This ratio is equivalent to the "golden" aspect ratio (i.e., a ratio of about f02:f20) described in WO97/09842 (U.S. Pat. No. 6,332,029). The method of improving the modality of a transducer may be extended by using three piezoelectric beams in the transducer. The ideal ratio is about 1.315:1.147:1.

The method of combining active elements, e.g. beams, may be extended to using piezoelectric discs. Using two discs, the ratio of sizes of the two discs depends upon how many modes are taken into consideration. For high order modal density, a ratio of fundamental frequencies of about 1.1+/−0.02 to 1 may give good results. For low order modal density (i.e., the first few or first five modes), a ratio of fundamental frequencies of about 3.2:1 is good. The first gap comes between the second and third modes of the larger disc.

Since there is a large gap between the first and second radial modes in each disc, much better interleaving is achieved with three rather than with two discs. When adding a third disc to the double disc transducer, the obvious first target is to plug the gap between the second and third modes of the larger disc of the previous case. However, geometric progression shows that this is not the only solution. Using fundamental frequencies of f0, $\alpha$.f0 and $\alpha^2$.f0, and plotting rms($\alpha$ $\alpha^2$) there exist two principal optima for $\alpha$. The values are about 1.72 and about 2.90, with the latter value corresponding to the obvious gap-filling method.

Using fundamental frequencies of f0, $\alpha$.f0 and $\beta$.f0, so that both scalings are free, and using the above values of $\alpha$ as seed values, slightly better optima may be achieved. The parameter pairs ($\alpha$,$\beta$) are (1.63, 3.03) and (3.20, 8.19). These optima are quite shallow, meaning that variations of 10%, or even 20%, in the parameter values are acceptable.

An alternative approach for determining the different discs to be combined is to consider the cost as a function of the ratio of the radii of the three discs. The cost functions may be RSCD (ratio of sum of central differences), SRCD (sum of the ratio of central differences) and SCR (sum of central ratios). For a set of modal frequencies, $f_0$, $f_1$, $f_n$, . . . $f_N$, these functions are defined as:

RSCD (R sum CD):

$$RSCD = \frac{\frac{1}{N-1}\sum_{n=1}^{N-1}(f_{n+1}+f_{n-1}-2f_n)^2}{f_0}$$

*SCRD* (sum *RCD*):

$$SRCD = \frac{1}{N-1}\sum_{n=1}^{N-1}\left(\frac{f_{n+1}+f_{n-1}-2f_n}{f_n}\right)^2$$

*SCR*:

$$SCR = \frac{1}{N-1}\sum_{n=1}^{N-1}\left(\frac{f_{n+1}\cdot f_{n-1}}{(f_n)^2}\right)$$

The optimum radii ratio (i.e., where the cost function is minimised) is 1.3 for all cost functions. Since the square of the radii ratio is equal to the frequency ratio, for these identical material and thickness discs, the results of (1.3)(1.3)=1.69 and the analytical result of 1.67 are in good agreement.

Figure 6:
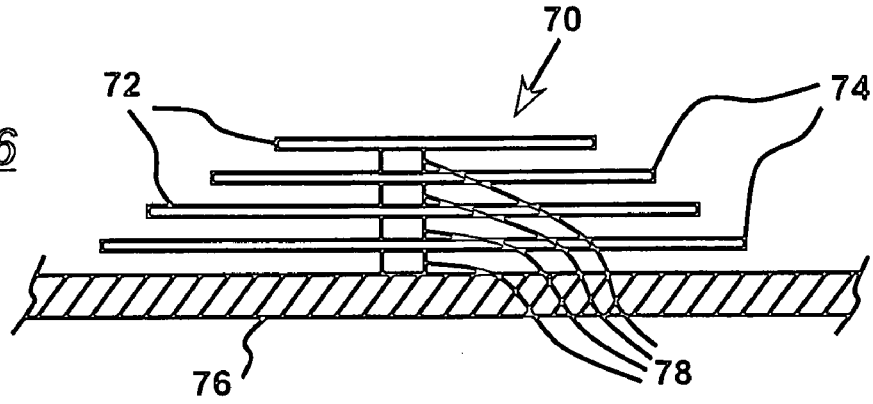

Alternatively or additionally, passive elements may be incorporated into the transducer to improve its overall modality. The active and passive elements may be arranged in a cascade. FIG. 6 shows a multiple disc transducer (70) comprising two active piezoelectric elements (72) stacked with two passive resonant elements (74), e.g. thin metal plates so that the modes of the active and passive elements are interleaved.

The elements are connected by connecting means in the form of stubs (78) located at the centre of each active and passive element. The elements (72, 74) are arranged concentrically. Each element has different dimensions with the smallest and largest discs located at the top and bottom of the stack, respectively. The transducer (70) is mounted on a load device (76), e.g. a panel, by coupling means in the form of a stub (78) located at the centre of the first passive device which is the largest disc.

The method of improving the modality of a transducer may be extended to a transducer comprising two active elements in the form of piezoelectric plates. Two plates of dimensions (1 by $\alpha$) and ($\alpha$ by $\alpha^2$) are coupled at (3/7, 4/9). The frequency ratio is therefore about 1.3:1 (1.14×1.14=1.2996).

Figure 7:
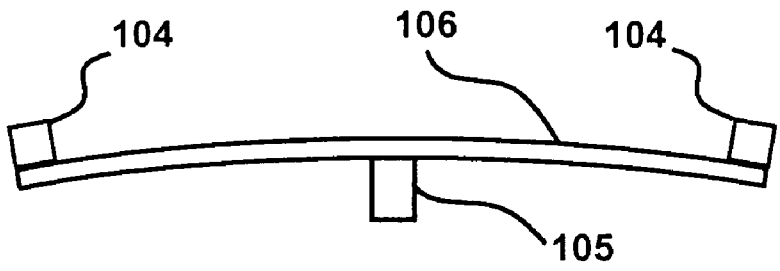
Figure 8:
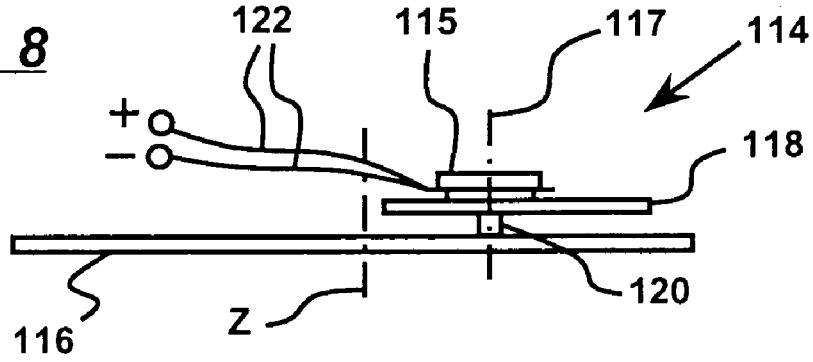

As shown in FIG. 7, small masses (104) may be mounted at the end of the piezoelectric transducer (106) having coupling means (105). In FIG. 8, the transducer (114) is an inertial electrodynamic moving coil exciter (e.g., as described in WO97/09842 and U.S. Pat. No. 6,332,029) having a voice coil forming an active element (115) and a passive resonant element in the form of a modal plate (118). The active element (115) is mounted on the modal plate (118) and off-centre of the modal plate.

The modal plate (118) is mounted on the panel (116) by a coupler (120). The coupler is aligned with the axis (117) of the active element (115) but not with the axis (Z) normal to the plane of the panel (116). Thus the transducer (114) is not coincident with the panel axis (Z). The active element (115) is connected to an electrical signal input via electrical wires (122). The modal plate (118) is perforate to reduce the acoustic radiation therefrom and the active element (115) is located off-centre of the modal plate (118), for example, at the optimum mounting position, i.e. about (3/7, 4/9).

Figure 9:
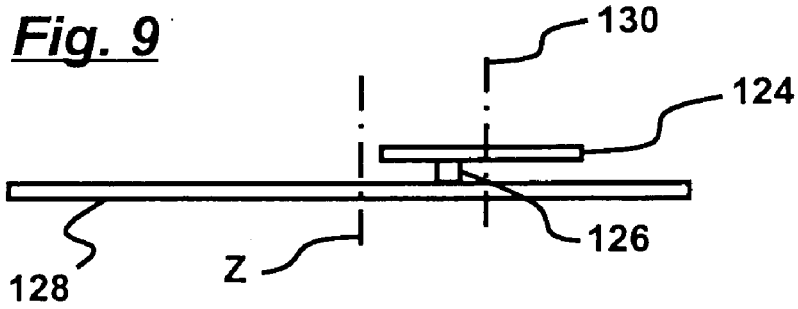

FIG. 9 shows a transducer (124) comprising an active piezoelectric resonant element which is mounted by a coupler (126) in the form of a stub to a panel (128). Both the transducer (124) and panel (128) have ratios of width to length of about 1:1.13. The coupler (126) is not aligned with any axes (130,Z) of the transducer (124) or the panel (128). Furthermore, the placement of the coupler (126) is located at the optimum position, i.e., off-centre with respect to both the transducer (124) and the panel (128).

Figure 10:
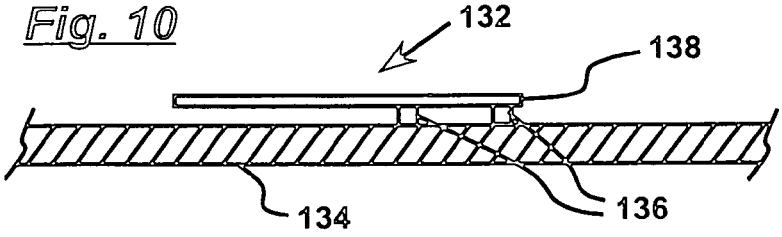

FIG. 10 shows a transducer (132) in the form of active piezoelectric resonant element in the form of a beam. The transducer (132) is coupled to a panel (134) by two couplers in the form of stubs (136). One stub (136) is located towards an end (138) of the beam and the other stub (136) is located towards the centre of the beam.

Figure 11:
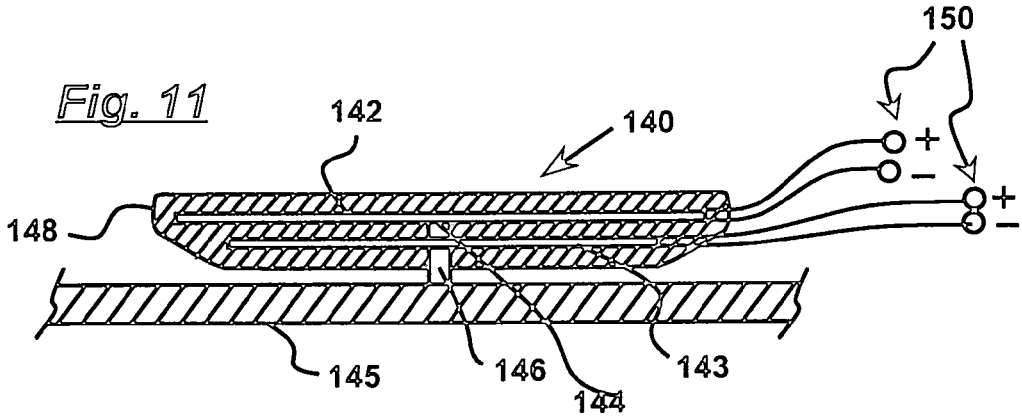

FIG. 11 shows a transducer (140) comprising two active resonant elements (142,143) coupled by a connector (144) and an enclosure (148) which surrounds the connector (144) and the resonant elements (142, 143). The transducer (140) is thus made shock and impact resistant. The enclosure (148) is made of a low mechanical impedance rubber or comparable polymer so as not to impede the transducer operation. If the polymer is water resistant, the transducer (140) may be made waterproof.

The upper resonant element (142) is larger than the lower resonant element (143) which is coupled to a panel (145) via a coupler in the form of a stub (146). The stub (146) is located at the centre of the lower resonant element (143). The power couplings (150) for each active element extend from the enclosure (148) to allow good audio attachment to a load device (not shown).

Figure 12:
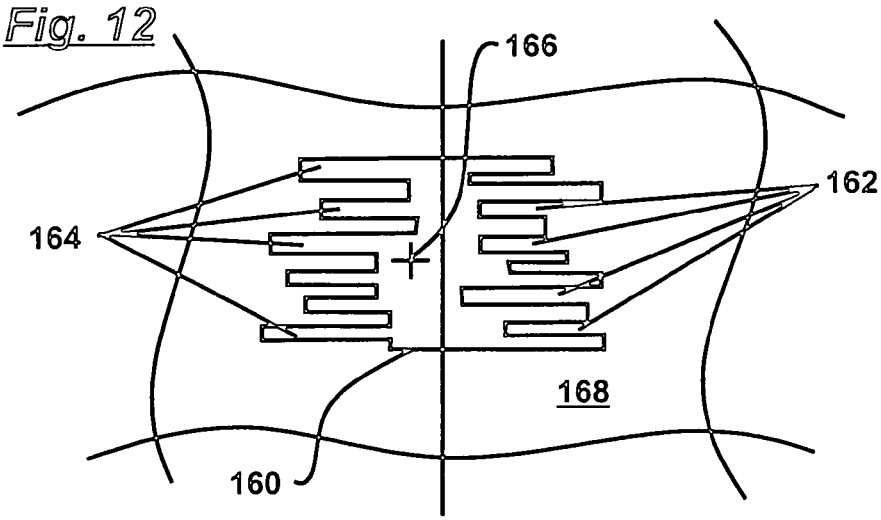
FIG. 12 is a plan view of an alternative modal transducer which may be used in the present invention.

FIG. 12 shows a transducer (160) in the form of a plate-like active resonant element. The resonant element is formed with slots (162) which define fingers (164) and thus form a multi-resonant system. The resonant element is mounted on a panel (168) by a coupler in the form of a stub (166).

Figure 13A:
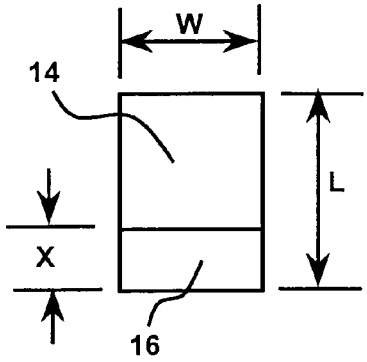
FIG. 13A is a schematic plan view of a parameterised model of a transducer which may be used in the present invention.
Figure 13B:
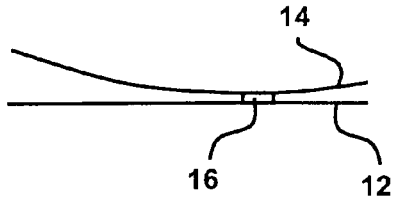
FIG. 13B is a section perpendicular to the line of attachment of the transducer of FIG. 13A.

In FIGS. 13A and 13B, the transducer (14) is rectangular with out-of-plane curvature and is a pre-stressed piezoelectric transducer of the type disclosed in U.S. Pat. No. 5,632,841 (International patent application WO 96/31333) and produced by PAR Technologies Inc. under the trade name NASDRIV. Thus, the transducer (14) is an active resonant element. The transducer has a width (W) and a length (L) and a position (x) defining an attachment point (16).

The curvature of the transducer (14) means that the coupler (16) is in the form of a line of attachment. When the transducer (14) is mounted along a line of attachment along the short axis through the centre, the resonance frequencies of the two arms of the transducer are coincident. The optimum suspension point may be modelled and has the line of attachment at about 43% to about 44% along the length of the resonant element. The cost function (or measure of "badness") is minimised at this value; this corresponds to an estimate for the attachment point at 4/9ths of the length. Furthermore, computer modelling showed this attachment point to be valid for a range of transducer widths. A second suspension point at about 33% to about 34% along the length of the resonant element also appears suitable.

By plotting a graph of cost (or rms central ratio) against aspect ratio (AR=W/2L) for a resonant element mounted at 44% along its length, the optimum aspect ratio may be determined to be about 1.06+/−0.01 to 1 since the cost function is minimised at this value.

The optimum angle of attachment θ to the panel (12) may be determined using two "measures of badness" to find the optimum angle. For example, the standard deviation of the log (dB) magnitude of the response is a measure of "roughness". Such figures of merit/badness are discussed in International Application WO 99/41939, and corresponding U.S. patent application Ser. No. 09/246,967, of the present applicants. For an optimised transducer, namely one with aspect ratio of about 1.06:1 and attachment point at about 44% using modelling, rotation of the line of attachment (16) will have a marked effect since the attachment position is not symmetrical. There is a preference for an angle of about 270°, i.e. with the longer end facing left.

Figure 14A:
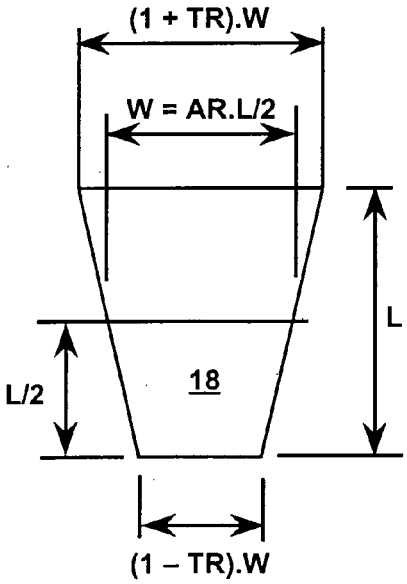
FIG. 14A is a schematic plan view of a parameterised model of a transducer which may be used in the present invention.
Figure 14B:
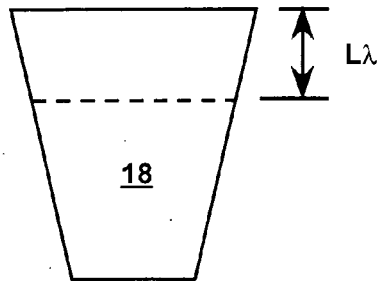
FIG. 14B is a second schematic plan view of the transducer of FIG. 14A.

FIGS. 14A and 14B show an asymmetrically shaped transducer (18) in the form of a resonant element having a trapezium shaped cross-section. The shape of a trapezium is controlled by two parameters, AR (aspect ratio) and TR (taper ratio). AR and TR determine a third parameter, λ, such that some constraint is satisfied, for example, equal mass on either side of the line.

The constraint equation for equal mass (or equal area) is as follows:

$$\int_0^{\lambda}\left(1+2TR\left(\frac{1}{2}-\xi\right)\right)d\xi=\int_{\lambda}^{1}\left(1+2TR\left(\frac{1}{2}-\xi\right)\right)d\xi$$

The above may readily be solved for either TR or λ as the dependent variable, to give:

$$TR=\frac{1-2\lambda}{2\lambda(1-\lambda)}\text{ or }\lambda=\frac{1+TR-\sqrt{1+TR^2}}{2TR}\approx\frac{1}{2}-\frac{TR}{4}$$

Equivalent expressions are readily obtained for equalising the moments of inertia, or for minimising the total moment of inertia.

The constraint equation for equal moment of inertia (or equal 2nd moment of area) is as follows:

$$\int_0^{\lambda}\left(1+2TR\left(\frac{1}{2}-\xi\right)\right)(\lambda-\xi)^2d\xi=\int_{\lambda}^{1}\left(1+2TR\left(\frac{1}{2}-\xi\right)\right)(\xi-\lambda)^2d\xi$$

$$TR=\frac{(\lambda^2-\lambda+1)(2\lambda-1)}{2\lambda^4-4\lambda^3+2\lambda-1}\text{ or }\lambda\approx\frac{1}{2}-\frac{TR}{8}$$

The constraint equation for minimum total moment of inertia is:

$$\frac{d}{d\lambda}\left(\int_0^{1}\left(1+2TR\left(\frac{1}{2}-\xi\right)\right)(\lambda-\xi)^2d\xi\right)=0$$

$$TR=3-6\lambda\text{ or }\lambda=\frac{1}{2}-\frac{TR}{6}$$

A cost function (measure of "badness") was plotted for the results of 40 FEA runs with AR ranging from 0.9 to 1.25, and TR ranging from 0.1 to 0.5, with λ constrained for equal mass. The transducer is thus mounted at the centre of mass. The results are tabulated below and show that there is an optimum shape with AR=1 and TR=0.3, giving λ at close to 43%.

| tr | λ | 0.9 | 0.95 | 1 | 1.05 | 1.1 | 1.15 | 1.2 | 1.25 |
|---|---|---|---|---|---|---|---|---|---|
| 0.1 | 47.51% | 2.24% | 2.16% | 2.16% | 2.24% | 2.31% | 2.19% | 2.22% | 2.34% |
| 0.2 | 45.05% | 1.59% | 1.61% | 1.56% | 1.57% | 1.50% | 1.53% | 1.66% | 1.85% |
| 0.3 | 42.66% | 1.47% | 1.30% | 1.18% | 1.21% | 1.23% | 1.29% | 1.43% | 1.59% |
| 0.4 | 40.37% | 1.32% | 1.23% | 1.24% | 1.29% | 1.25% | 1.29% | 1.38% | 1.50% |
| 0.5 | 38.20% | 1.48% | 1.44% | 1.48% | 1.54% | 1.56% | 1.58% | 1.60% | 1.76% |

One advantage of a trapezoidal transducer is thus that the transducer may be mounted along a line of attachment which is at its centre of gravity/mass but is not a line of symmetry. Such a transducer would thus have the advantages of improved modal distribution, without being inertially unbalanced. The two methods of comparison used previously again select about 270° to about 300° as the optimum angle of orientation.

The transducer used in the present invention may be seen as the reciprocal of a distributed mode panel, e.g. as described in WO97/09842 and U.S. Pat. No. 6,332,029, in that the transducer is designed to be a distributed mode object.

It should be understood that this invention has been described by way of examples only and that a wide variety of modifications can be made without departing from the scope of the invention as described in the accompanying claims.

We claim:

1. A bending wave loudspeaker, comprising:

a transparent acoustic radiator adapted to support bending wave vibration; and an electromechanical force transducer mounted to the acoustic radiator to excite bending waves in the acoustic radiator to produce an acoustic output, wherein the transducer has an intended operative frequency range and comprises:

at least one resonant element having a frequency distribution of modes in the operative frequency range, wherein parameters of the resonant element are such as to enhance the distribution of modes in the resonant element in the operative frequency range and wherein the distribution of modes in the resonant element has a density of modes which is sufficient for the resonant element to provide an effective mean average force which is substantially constant with frequency; and a coupler mounting the transducer to the acoustic radiator.

2. A loudspeaker according to claim 1, wherein the modes are distributed substantially evenly over the intended operative frequency range.

3. A loudspeaker according to claim 1, wherein the resonant element is modal along two substantially normal axes, each axis having an associated fundamental frequency, and wherein the ratio of the two associated fundamental frequencies is adjusted for best modal distribution.

4. A loudspeaker according to claim 3, wherein the ratio of the two fundamental frequencies is about 9:7.

5. A loudspeaker according to claim 1, wherein the resonant element is plate-like.

6. A loudspeaker according to claim 1, wherein the shape of the resonant element is selected from the group consisting of beam-like, trapezoidal, hyperelliptical, generally disc shaped, and rectangular.

7. A loudspeaker according to claim 6, wherein the resonant element is plate-like.

8. A bending wave loudspeaker comprising:

a transparent acoustic radiator adapted to support bending wave vibration; and an electromechanical force transducer mounted to the acoustic radiator to excite bending waves in the acoustic radiator to produce an acoustic output, wherein the transducer has an intended operative frequency range and comprises:

a plurality of resonant elements each having a frequency distribution of modes in the operative frequency range; wherein parameters of the resonant elements are such as to enhance the distribution of modes in the resonant elements in the operative frequency range and wherein the modes of the resonant elements are arranged to interleave in the operative frequency range whereby the distribution of modes in the transducer is enhanced, and a coupler mounting the transducer to the acoustic radiator.

9. A bending wave loudspeaker, comprising:

a transparent acoustic radiator adapted to support bending wave vibration; the acoustic radiator having a first face and a second face.

an electromechanical force transducer mounted to the first face of the acoustic radiator to excite bending waves in the acoustic radiator to produce an acoustic output, and a mask mounted to the second face of the acoustic radiator to obscure the transducer, wherein the transducer has an intended operative frequency range and comprises:

at least one resonant element having a frequency distribution of modes in the operative frequency range; and wherein parameters of the resonant element are such as to enhance the distribution of modes in the resonant element in the operative frequency range and wherein the distribution of modes in the resonant element has a density of modes which is sufficient for the resonant element to provide an effective mean average force which is substantially constant with frequency, and a coupler mounting the transducer to the acoustic radiator.

10. A loudspeaker according to claim 9, wherein the modes are distributed substantially evenly over the intended operative frequency range.

11. A loudspeaker according to claim 9, wherein the resonant element is modal along two substantially normal axes, wherein each axis has an associated fundamental frequency, and wherein the ratio of the two associated fundamental frequencies is adjusted for best modal distribution.

12. A loudspeaker according to claim 9, further comprising:

a frame which at least partially surrounds the acoustic radiator; and a suspension for mounting the acoustic radiator to the frame.

13. A loudspeaker according to claim 12, wherein the frame acts as a baffle.

14. A telephone handset comprising:

a body supporting a microphone, at least one key, a display, and a window mounted over the display; and a bending wave loudspeaker comprising:

a transparent acoustic radiator adapted to support bending wave vibration; and an electromechanical force transducer mounted to the acoustic radiator to excite bending waves in the acoustic radiator to produce an acoustic output, wherein the transducer has an intended operative frequency range and comprises:

a resonant element having a frequency distribution of modes in the operative frequency range; wherein parameters of the resonant element are such as to enhance the distribution of modes in the resonant element in the operative frequency range, and wherein the distribution of modes in the resonant element has a density of modes which is sufficient for the resonant element to provide an effective mean average force which is substantially constant with frequency, a coupler mounting the transducer to the acoustic radiator, and wherein the window is operable as the acoustic radiator.

15. A telephone handset according to claim 14, wherein the modes are distributed substantially evenly over the intended operative frequency range.

16. A telephone handset comprising:

a body supporting a microphone, at least one key, a display, and a window mounted over the display;

a bending wave loudspeaker comprising:

a transparent acoustic radiator adapted to support bending wave vibration; and an electromechanical force transducer mounted to the acoustic radiator to excite bending waves in the acoustic radiator to produce an acoustic output, wherein the transducer has an intended operative frequency range and comprises:

a resonant element having a frequency distribution of modes in the operative frequency range; wherein parameters of the resonant element are such as to enhance the distribution of modes in the resonant element in the operative frequency range, and a coupler mounting the transducer to the acoustic radiator, and wherein the window is operable as the acoustic radiator;

the handset further comprising: a suspension which supports the window on the body and which prevents transmission of vibration from the window to the body.

17. A visual display unit comprising:

a body supporting a display unit and a window mounted over the display; and a bending wave loudspeaker comprising:

a transparent acoustic radiator capable of supporting bending wave vibration; and an electromechanical force transducer mounted to the acoustic radiator to excite bending waves in the acoustic radiator to produce an acoustic output, wherein the transducer has an intended operative frequency range and comprises:

a resonant element having a frequency distribution of modes in the operative frequency range, wherein parameters of the resonant element are such as to enhance the distribution of modes in the resonant element in the operative frequency range, and wherein the distribution of modes in the resonant element has a density of modes which is sufficient for the resonant element to provide an effective mean average force which is substantially constant with frequency; and a coupler mounting the transducer to the acoustic radiator, and wherein the window is operable as the acoustic radiator.

18. A visual display unit according to claim 17, wherein the modes are distributed substantially evenly over the intended operative frequency range.

19. A bending wave loudspeaker comprising:

a transparent acoustic radiator adapted to support bending wave vibration; and an electromechanical force transducer mounted to the acoustic radiator to excite bending waves in the acoustic radiator to produce an acoustic output, wherein the transducer has an intended operative frequency range and comprises:

a plurality of resonant elements each having a frequency distribution of bending wave modes in the operative frequency range, at least one connector coupling the plurality of resonant elements together, and a coupler mounting the transducer to the acoustic radiator, wherein at least one of the parameters of the transducer is such as to enhance the distribution of bending wave modes in the resonant elements in the operative frequency range.

20. A bending wave loudspeaker according to claim 19, wherein the at least one parameter of the transducer is selected from the group consisting of relative aspect ratios, relative bending stiffnesses, relative thicknesses and relative geometries of the plurality of resonant elements.

21. A bending wave loudspeaker according to claim 20, wherein the at least one parameter of the transducer comprises the location of the at least one connector on each of the plurality of resonant elements.

22. A bending wave loudspeaker according to claim 21, wherein the at least one parameter of the transducer comprises the location of the coupler on the transducer.

23. A bending wave loudspeaker according to claim 19, wherein the at least one parameter of the transducer comprises the location of the at least one connector on each of the plurality of resonant elements.

24. A bending wave loudspeaker according to claim 19, wherein the at least one parameter of the transducer comprises the location of the coupler on the transducer.

25. A bending wave loudspeaker comprising:

a transparent acoustic radiator adapted to support bending wave vibration; and an electromechanical force transducer mounted to the acoustic radiator to excite bending waves in the acoustic radiator to produce an acoustic output, wherein the transducer has an intended operative frequency range and comprises:

at least one resonant element having a frequency distribution of bending wave modes in the operative frequency range and being modal along two substantially normal axes, and a coupler mounting the transducer to the acoustic radiator, the coupler being attached to the resonant element at a position which is beneficial for coupling modal activity of the resonant element to the acoustic radiator, wherein at least one of the parameters of the transducer is such as to enhance the distribution of bending wave modes in the resonant element in the operative frequency range.

26. A bending wave loudspeaker according to claim 25, wherein the at least one parameter is selected from the group consisting of aspect ratio, bending stiffness, and thickness of the resonant element.

27. A bending wave loudspeaker comprising:

a transparent acoustic radiator adapted to support bending wave vibration; and an electromechanical force transducer mounted to the acoustic radiator to excite bending waves in the acoustic radiator to produce an acoustic output, wherein the transducer has an intended operative frequency range and comprises:

at least one resonant element having a frequency distribution of bending wave modes in the operative frequency range, and a coupler mounting the transducer to the acoustic radiator, the coupler being attached to the resonant element at a position which is away from the centre of the resonant element and which is beneficial for coupling modal activity of the resonant element to the acoustic radiator, wherein at least one of the parameters of the transducer is such as to enhance the distribution of bending wave modes in the resonant element in the operative frequency range.

28. A bending wave loudspeaker according to claim 27, wherein the shape of the resonant element is such as to provide an off-centre line of attachment which is generally at the centre of mass of the resonant element.

29. A bending wave loudspeaker according to claim 28, wherein the resonant element is in the shape of a trapezium.

30. A bending wave loudspeaker according to claim 28, wherein the resonant element is in the shape of a trapezoid.

* * * * *